US010555084B2

(12) United States Patent
Li et al.

(10) Patent No.: US 10,555,084 B2
(45) Date of Patent: Feb. 4, 2020

(54) LOUDSPEAKER HAVING OPEN TYPE INDUCTIVE COIL

(71) Applicant: TYMPHANY ACOUSTIC TECHNOLOGY (HUIZHOU) CO., LTD., Huizhou, Guangdong Province (CN)

(72) Inventors: Zhi Li, Huizhou (CN); Tung-Ko Lu, Huizhou (CN)

(73) Assignee: TYMPHANY ACOUSTIC TECHNOLOGY (HUIZHOU) CO., LTD., Huizhou, Guangdong Province (CN)

( * ) Notice: Subject to any disclaimer, the term of this patent is extended or adjusted under 35 U.S.C. 154(b) by 8 days.

(21) Appl. No.: 16/135,936

(22) Filed: Sep. 19, 2018

(65) Prior Publication Data

US 2019/0090062 A1 Mar. 21, 2019

(30) Foreign Application Priority Data

Sep. 19, 2017 (CN) ..... 2017 1 0845748

(51) Int. Cl.

| | |
|---|---|
| ***H04R 9/02*** | (2006.01) |
| ***H04R 1/02*** | (2006.01) |
| ***H04R 9/06*** | (2006.01) |
| ***H04R 3/04*** | (2006.01) |
| ***H04R 29/00*** | (2006.01) |

(52) U.S. Cl.

CPC ..... *H04R 9/025* (2013.01); *H04R 1/02* (2013.01); *H04R 3/04* (2013.01); *H04R 9/06* (2013.01); *H04R 29/001* (2013.01); *H04R 2420/03* (2013.01); *H04R 2430/00* (2013.01)

(58) Field of Classification Search

CPC ..... H04R 9/022; H04R 9/047; H04R 9/06; H04R 29/003; H04R 9/063

USPC ..... 381/59, 401, 111, 116, 194, 196, 203, 381/165, 397, 386, 399

See application file for complete search history.

(56) References Cited

U.S. PATENT DOCUMENTS 5,426,707 A * 6/1995 Wijnker ..... H04R 9/022 381/165

2004/0196987 A1* 10/2004 Sahyoun ..... H04R 1/06 381/111

(Continued)

*Primary Examiner* — Curtis A Kuntz

*Assistant Examiner* — Julie X Dang

(74) *Attorney, Agent, or Firm* — Muncy, Geissler, Olds & Lowe, P.C.

(57) ABSTRACT

A loudspeaker includes a yoke, an annular magnet, a voice coil, and an open type inductive coil. The annular magnet is combined to the yoke, and a magnetic gap is provided between the annular magnet and the yoke. The voice coil is disposed in the magnetic gap. The open type inductive coil is combined to the yoke or the annular magnet, and the open type inductive coil corresponds to the voice coil. An inductive gap is located between the open type inductive coil an the voice coil, where the open type inductive coil includes a coil unit and two signal transmission lines. The coil unit includes opposite open ends, first ends of the signal transmission lines are respectively connected to the open ends, and second ends of the signal transmission lines are exposed out of the yoke and the annular magnet, so as to transmit mutual inductance signals between the coil unit and the voice coil to outside.

10 Claims, 6 Drawing Sheets

(56) References Cited

U.S. PATENT DOCUMENTS

| | | | | |
|---|---|---|---|---|
| 2014/0010402 | A1* | 1/2014 | French | H04R 9/04 381/400 |
| 2014/0198920 | A1* | 7/2014 | Lee | G08B 29/06 381/59 |
| 2015/0055819 | A1* | 2/2015 | Cheung | H04R 9/025 381/401 |
| 2016/0227325 | A1* | 8/2016 | Pare | H04R 1/06 |

* cited by examiner

LOUDSPEAKER HAVING OPEN TYPE INDUCTIVE COIL

CROSS REFERENCE TO RELATED APPLICATIONS

This application claims priority to CN 201710845748.5, which was filed on Sep. 19, 2017, and which is herein incorporated by reference.

BACKGROUND

Technical Field

The present application relates to a loudspeaker, and in particular, to a loudspeaker having an open type inductive coil.

Related Art

A general electric type loudspeaker structure mainly consists of a diaphragm, a voice coil, and a magnetic circuit. Alternate magnetic field changes may be generated when a signal current is introduced into a voice coil, so that magnetic forces (an attractive force and an expulsive force) of different levels may be generated in the magnetic circuit, to further lead to movement of the connected voice coil and diaphragm, thereby generating a sound wave to be transmitted to people's ears by means of air vibration.

However, the electric impedance of a general electric type loudspeaker plainly increases along with increase of the frequency within an intermediate or high frequency range. The electric power consumed by the loudspeaker needs to reduce at an input of a constant voltage into the loudspeaker, which results in reduction in the sound power of the loudspeaker and influences an output effect thereof at an intermediate or high frequency.

In view of the above, a conventional solution is sheathing a closed metal ring on a central post of the magnetic circuit, to reduce impact of the inductance of the voice coil. However, by using the method of adding a closed metal ring, a limited amount of inductance can be eliminated and it is impossible to clearly learn about a matched result among the closed metal ring, the voice coil, and the magnetic circuit, so that adjustment cannot be performed and the quality of products is apt to be influenced.

SUMMARY

In view of the above, the present application provides a loudspeaker including: a yoke, an annular magnet, a voice coil, and an open type inductive coil. The annular magnet is attached to the yoke, and a magnetic gap is provided between the annular magnet and the yoke. The voice coil is disposed in the magnetic gap. The open type inductive coil is attached to or disposed within the yoke or the annular magnet. An inductive gap is located between the open type inductive coil and the corresponded voice coil, where the open type inductive coil includes a coil unit and two signal transmission lines, the coil unit includes opposite open ends, first ends of the signal transmission lines are respectively connected to the open ends, and second ends of the signal transmission lines are exposed out of the yoke and the annular magnet, so as to transmit mutual inductance signals between the coil unit and the voice coil to outside.

In an embodiment, the yoke includes a U-shaped cross section, a disc body and an outer ring combined to an outer circumference of the disc body. The annular magnet is disposed on the disc body. The magnetic gap is located between the outer ring and the annular magnet. A ring-shape trench is provided in an outer circumference of the annular magnet. The coil unit is wound in the ring-shape trench.

In an embodiment, the annular magnet includes a magnet and a washer stacked on the magnet, and the ring-shape trench is provided in an outer circumference of the washer.

In an embodiment, the yoke includes a T-shaped cross section, a chassis, and a central post attached to or integrally formed with the center of the chassis. The annular magnet is disposed on the chassis, the magnetic gap is located between the central post and the annular magnet, an annular recess is provided in an outer circumference of the central post, and the coil unit is wound in the annular recess.

In an embodiment, the coil unit is a multi-turn metal wire or a metal ring having a notch.

In an embodiment, the two signal transmission lines are further connected to a signal processor for receiving the mutual inductance signals, where the mutual inductance signals include a voice coil input signal and a coil feedback signal, and the signal processor optionally processes for adding or subtracting the voice coil input signal and the coil feedback signal.

In an embodiment, a signal amplifier is further connected between the two signal transmission lines and the signal processor, and the signal amplifier amplifies the mutual inductance signals and transmits the amplified mutual inductance signals to the signal processor.

In an embodiment, the two signal transmission lines are further connected to a signal switch-over switch.

In an embodiment, the loudspeaker further includes two electric connection terminals, and second ends of the two signal transmission lines are respectively, electrically connected to the two electric connection terminals and are connected in parallel with the voice coil.

In an embodiment, the two signal transmission lines are connected in series with the voice coil.

The loudspeaker of the present application may transmit mutual inductance signals between the coil unit and the voice coil to the outside by means of the signal transmission lines of the open type inductive coil, so that the mutual inductance signals can be obtained for use, adjustment, or monitoring, to further reduce the inductance at intermediate or high frequency, improve the sensibility of the loudspeaker, and change a sound field or monitor and adjust signals in a process of producing a product so as to improve the quality of the product.

DETAILED DESCRIPTION

Figure 1:
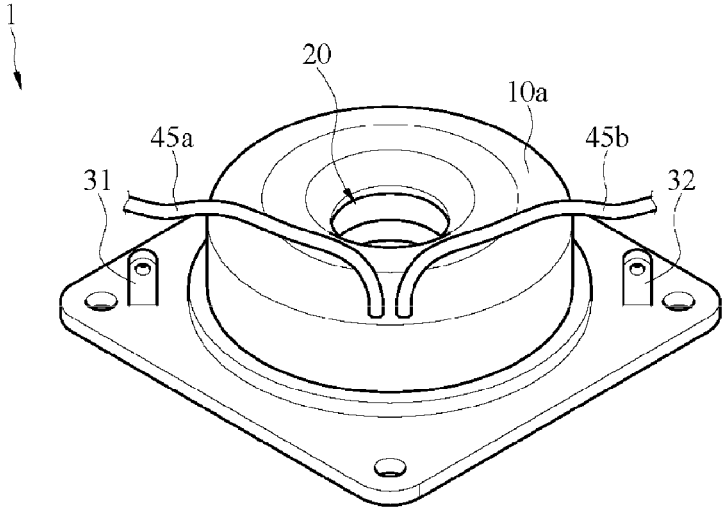
FIG. 1 is a schematic three-dimensional diagram of a loudspeaker according to an embodiment of the present application.
Figure 2:
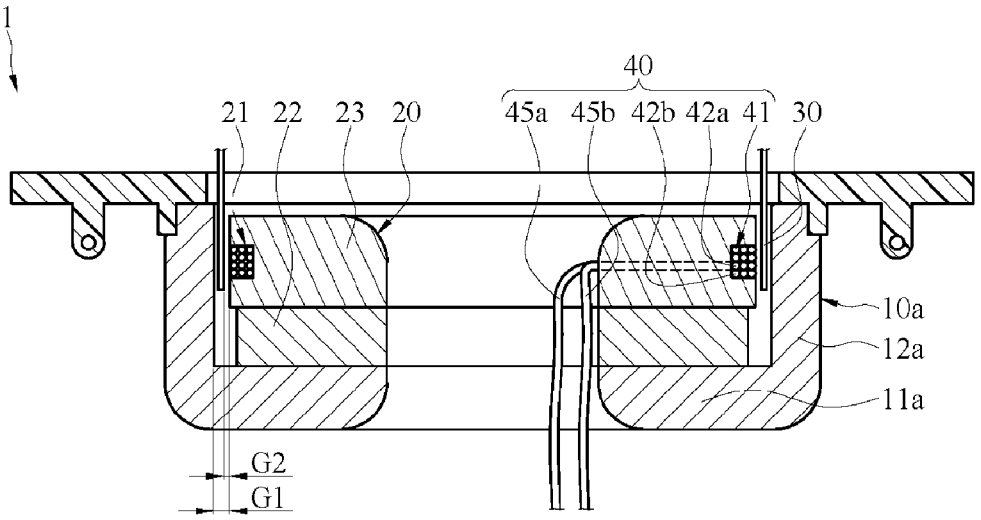
FIG. 2 is a schematic cross sectional diagram of a loudspeaker according to an embodiment of the present application.

Referring to FIG. 1 and FIG. 2, the present application provides a loudspeaker 1, including a yoke 10*a*, an annular magnet 20, a voice coil 30, and an open type inductive coil 40. The annular magnet 20 may be made of a permeability magnetic material and combined with the yoke 10*a*, and a magnetic gap G1 is provided between the annular magnet 20 and the yoke 10*a*, thereby forming a magnetic circuit device.

Figure 3:
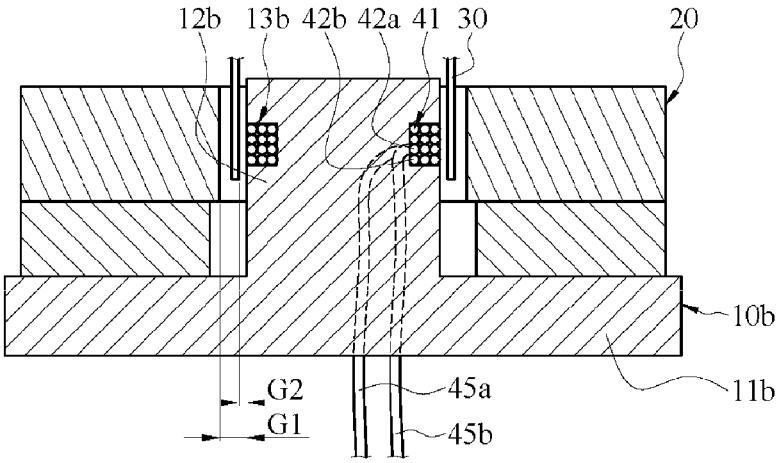
FIG. 3 is a schematic cross sectional diagram of a loudspeaker according to another embodiment of the present application.

Further, in the embodiment of FIG. 2, the yoke 10*a* includes a U-shaped cross section and a disc body 11*a*, and an outer ring 12*a* is attached to (or integrally formed with) an outer circumference of the disc body 11*a*. The annular magnet 20 is disposed on the disc body 11*a* and located inside the outer ring 12*a*. The magnetic gap G1 is located between the outer ring 12*a* and the annular magnet 20. However, this embodiment is for illustration only, and the yoke 10*a* may be any other different shapes (such as T shape, L shape, or other irregular shapes, etc.), so that different arrangements with the annular magnet 20 are obtained. For example, FIG. 3 shows another embodiment, in which the yoke 10*b* may include a T-shaped cross section and a chassis 11*b*, and a central post 12*b* is attached to (or integrally formed with) a center of the chassis 11*b*. The annular magnet 20 is disposed on the chassis 11*b* and surrounds an outer circumference of the central post 12*b*. The magnetic gap G1 is located between the central post 12*b* and the annular magnet 20.

Referring to FIG. 1 and FIG. 2, in this embodiment, the voice coil 30 is disposed in the magnetic gap G1. For example, the voice coil 30 may be suspended in the magnetic gap G1 and be connected to a diaphragm (not shown), so that the voice coil 30 is located between the yoke 10*a* and the annular magnet 20 and is spaced from the yoke 10*a* and the annular magnet 20 at a distance. When a current passes through the voice coil 30, alternate magnetic field changes may be generated and magnetic lines are cut in the magnetic gap G1, so that magnetic forces (an attractive force and an expulsive force) of different strengths may be generated in the magnetic circuit, to further drive the voice coil 30 moving and further lead to simultaneous movement of the diaphragm that is connected to the voice coil 30, thereby generating a sound wave to be transmitted to people's ears by means of air vibration.

Referring to FIG. 1 and FIG. 2, the open type inductive coil 40 is attached to or arranged in the annular magnet 20, and the open type inductive coil 40 corresponds to the voice coil 30. An inductive gap G2 is located between the open type inductive coil 40 and the voice coil 30. For example, in this embodiment, the open type inductive coil 40 includes a coil unit 41. The coil unit 41 is slightly higher than the bottom of the voice coil 30, so that the coil unit 41 and the voice coil 30 have an overlapped area and therefore correspond to each other. The inductive gap G2 is smaller than the magnetic gap G1 between the magnet 20 and the yoke 10*a*. For example, the magnetic gap G1 may be in a range of 0.4 mm to 0.6 mm, and the inductive gap G2 may be in a range of 0.2 mm to 0.3 mm. However, this embodiment is for illustration only, the open type inductive coil 40 may alternatively be attached to the yoke 10*a*, and the magnetic gap G1 and the inductive gap G2 may also be different sizes according to actual needs.

Referring to FIG. 1 and FIG. 2, the open type inductive coil 40 further includes signal transmission lines 45*a*, 45*b*, and the coil unit 41 of the open type inductive coil 40 includes two opposite open ends 42*a*, 42*b*. The open end 42*a* may be a positive end, and the open end 42*b* may be a negative end. For example, the coil unit 41 may be a multi-turn metal wire, and two tail ends of the metal wire are the two open ends 42*a*, 42*b*. However, this is only an example, but is not used to limit the present application. The coil unit 41 may also be a metal ring having a notch (not shown) instead of a closed metal ring, so as to form two end portions that are not connected to each other. The two end portions that are not connected to each other are the two open ends 42*a*, 42*b*. Alternate magnetic field changes may be generated when a current passes through the voice coil, so that mutual inductance signals are generated between the voice coil 30 and the coil unit 41 of the open type inductive coil 40.

Further, in the embodiment of FIG. 2, a ring-shape trench 21 is provided in an outer circumference of the annular magnet 20. The coil unit 41 of the open type inductive coil 40 is wound in the ring-shape trench 21, so that the coil unit 41 does not occupy the magnetic gap G1 between the magnet 20 and the yoke 10*a*, thereby avoiding interference with movement of the voice coil 30 and impact on the magnetic field intensity of the magnetic gap G1. Further, the annular magnet 20 may include a magnet 22 and a washer 23 stacked on the magnet 22. The ring-shape trench 21 is provided in an outer circumference of the washer 23. In other embodiments, the ring-shape trench 21 may be located in an inner circumference of the yoke 10*a*, so that the coil unit 41 is wound in the ring-shape trench 21 to be combined with the yoke 10*a*.

In the embodiment of FIG. 3, an annular recess 13*b* is provided in an outer circumference of the central post 12*b* of the yoke 10*b*, and the coil unit 41 of the open type inductive coil 40 is wound in the annular recess 13*b* to be mounted in the yoke 10*b*, so that the coil unit 41 likewise does not occupy the magnetic gap G1 between the magnet 20 and the yoke 10*b*. In other embodiments, the annular recess 13*b* may also be provided in an inner circumference of the annular magnet 20, and the coil unit 41 may be wound in the annular recess 13*b* to be mounted in the annular magnet 20.

According to the embodiments of FIG. 1 and FIG. 3, one of the signal transmission lines 45*a* of the open type inductive coil 40 has a first end connected to the open end 42*a* and a second end exposed out of the yoke 10 and the annular magnet 20. A first end of the other signal transmission line 45*b* is connected to the open end 42*b*, and a second end of the signal transmission line 45*b* is exposed out of the yoke 10 and the annular magnet 20. In this way, when a current passes through the voice coil 30, the mutual inductance signals between the coil unit 41 and the voice coil 30 can be transmitted to the outside by means of the two signal transmission lines 45*a*, 45*b*, so that the mutual inductance signal can be obtained for use, adjustment, or monitoring, to further reduce the inductance of the loudspeaker at intermediate or high frequency, improve the sensibility of the loudspeaker, and change a sound field or monitor and adjust signals in a process of producing a product so as to improve the quality of the product.

Figure 4:
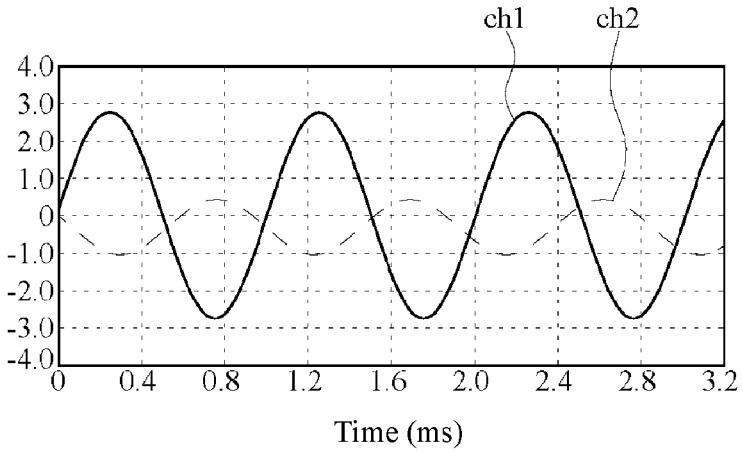
FIG. 4 is a schematic diagram of mutual inductance signals of a loudspeaker according to an embodiment of the present application.
Figure 5:
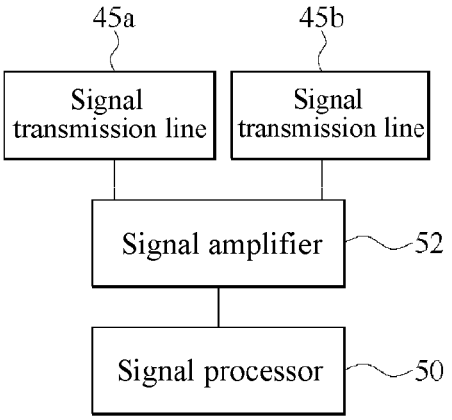
FIG. 5 is a schematic diagram of functional blocks of a loudspeaker according to an embodiment of the present application.
Figure 6:
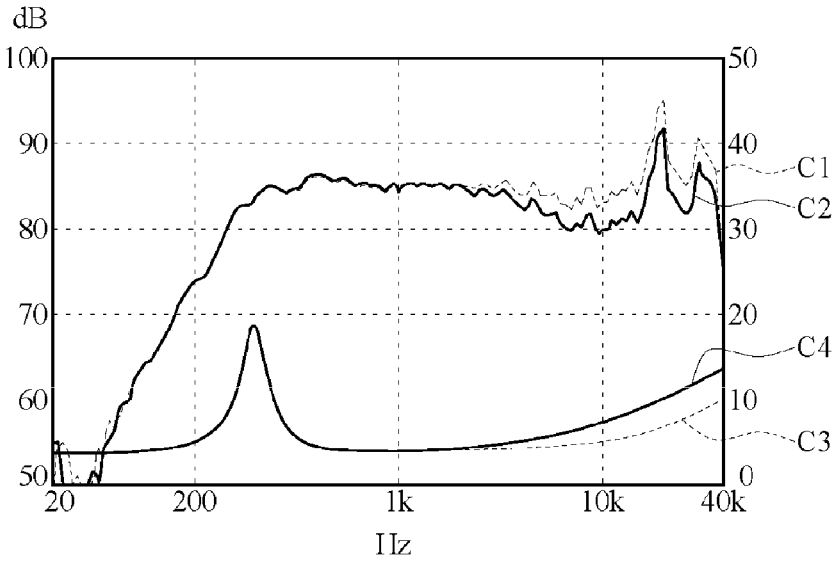
FIG. 6 is a signal curve chart of a loudspeaker according to an embodiment of the present application.

For example, referring to FIG. 4, the mutual inductance signals between the voice coil 30 and the coil unit 41 may include a voice coil input signal ch1 and a coil feedback signal ch2. For example, as shown in FIG. 4, the voice coil input signal ch1 forms a sine wave, and the coil feedback signal ch2 forms another sine wave having different amplitude. By obtaining the mutual inductance signals between the coil unit 41 and the voice coil 30, the mutual inductance signals can be processed. As compared with a conventional closed metal ring, the method can further reduce the inductance of the loudspeaker 1 at an intermediate or a high frequency and improve the sensitivity at an intermediate or a high frequency, thereby improving the sensibility of the loudspeaker 1. For example, in the embodiment of FIG. 5, the two signal transmission lines 45*a*, 45*b* may be connected to a signal processor 50 for receiving the mutual inductance signals. The signal processor 50 may add the voice coil input signal ch1 to the coil feedback signal ch2. For example, the signal processor 50 may delay the coil feedback signal ch2, so that the coil feedback signal ch2 can be superposed with voice coil input signal ch1, so as to reduce the inductance of the loudspeaker 1 at an intermediate or a high frequency and improve the sensitivity at an intermediate or a high frequency, thereby improving the sensibility of the loudspeaker 1. FIG. 6 shows a comparison of differences between the loudspeaker 1 using a conventional metal ring and the loudspeaker using an open type inductive coil 40 of the present application. The horizontal axis represents the frequency (Hz), the left vertical axis represents the sound pressure level (dB), and the right vertical axis represents the inductance. The curve C1 shows a sound pressure level-frequency curve generated when an open type inductive coil 40 is used, the curve C2 shows a sound pressure level-frequency curve generated when a closed metal ring is used, the curve C3 shows an inductance-frequency curve generated when an open type inductive coil 40 is used, and the curve C4 shows an inductance-frequency curve generated when a closed metal ring is used. By comparing the curve C3 and the curve C4, it can be learned that the use of the open type inductive coil 40 can further reduce the inductance as compared with the use of the closed metal ring in an area at an intermediate or a high frequency band. In the present application, due to the reduction in the inductance, relatively, by comparing the curve C1 and the curve C2, the use of the open type inductive coil 40 can generate a relatively larger sound pressure level (that is, the sensitivity and sensibility are improved) as compared with the use of the closed metal ring in an area at an intermediate or high frequency band.

Further, in addition to superposing the coil feedback signal ch2 and the voice coil input signal ch1, the signal processor 50 may also subtract the coil feedback signal ch2 and the voice coil input signal ch1, so as to generate different sensitivity and sensibility. That is, in the present application, signal superposition or subtraction can be performed after the mutual inductance signals between the voice coil 30 and the coil unit 41 being obtained, so as to generate different sound fields according to actual needs and enable sound output of the loudspeaker 1 to be more flexible.

Again referring to FIG. 5, in an embodiment, a signal amplifier 52 is further electrically connected between the two signal transmission lines 45*a*, 45*b* and to the signal processor 50. The signal amplifier 52 amplifies the mutual inductance signals and transmits the amplified mutual inductance signals to the signal processor 50, so that the signal processor 50 can perform signal superposition or subtraction more precisely. Moreover, by amplifying the mutual inductance signals, whether the inductance or the sensitivity reaches a standard value can also be easily determined. If the inductance or the sensitivity does not reach the standard value, the voice coil input signal ch1 and the coil feedback signal ch2 in the mutual inductance signals may also added or subtracted, so as to adjust the inductance or the sensitivity to predetermined values, thereby improving the quality of the product.

Figure 7:
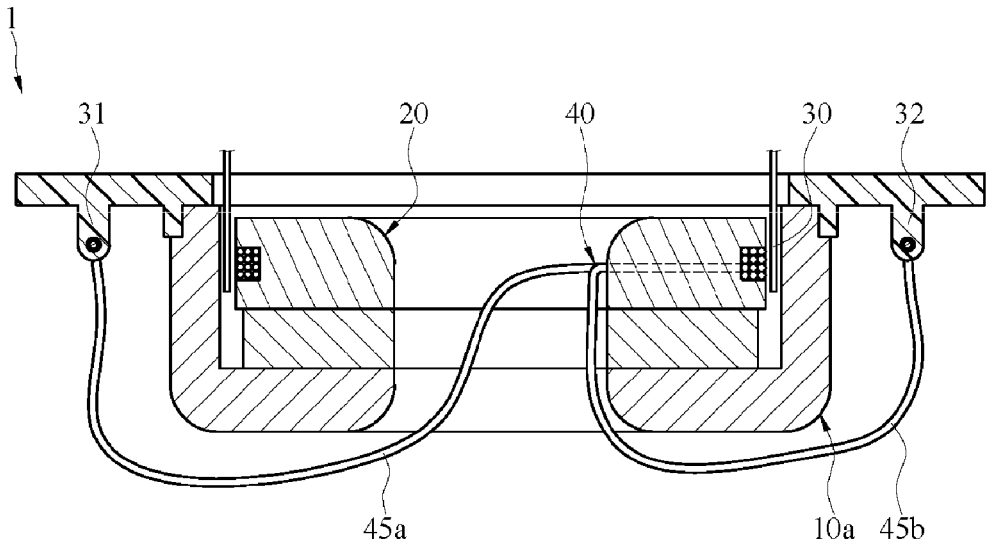
FIG. 7 is a schematic application diagram of a loudspeaker according to an embodiment of the present application.
Figure 8:
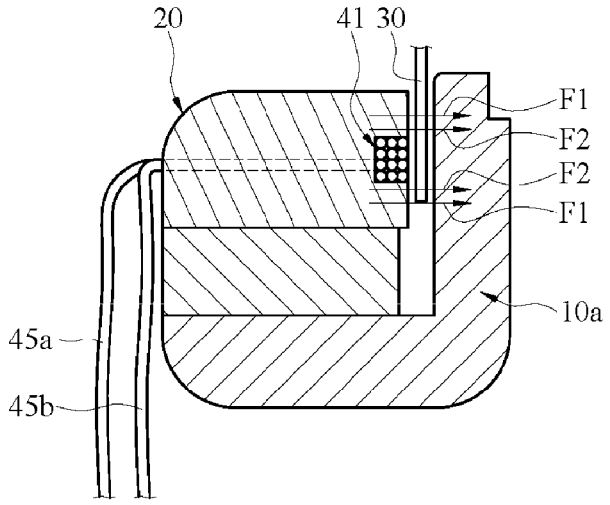
FIG. 8 is an interactive diagram of FIG. 7.

Referring to FIG. 7, FIG. 7 shows another embodiment of the use of the mutual inductance signals. The voice coil 30 may be electrically connected to two electric connection terminals 31, 32 (a positive electric connection terminal and a negative electric connection terminal), so as to conduct electricity to the voice coil 30 by means of the two electric connection terminals 31. One ends of the two signal transmission lines 45*a*, 45*b* that are exposed out of the yoke 10 and the annular magnet 20 are respectively, electrically connected to the two electric connection terminals 31, 32 and connected in parallel with the voice coil 30, thereby greatly improving the sensibility of the loudspeaker 1. Further, referring to FIG. 8, when the two signal transmission lines 45*a*, 45*b* are connected to the two electric connection terminals 31, 32, the voice coil 30 may also receive a force from the open type inductive coil 40 when receiving a force generated in the magnetic circuit. For example, when a current is input by means of the two electric connection terminals 31, 32 of the loudspeaker 1, the voice coil 30 is electrified, so that the magnetic circuit generates a first driving force (F1 in FIG. 8) against the voice coil 30. The first driving force F1 may be a product of the magnetic induction density of the magnetic gap G1, the length of the voice coil 30, and the current of the voice coil 30. In addition, the open type inductive coil 40 is also electrified so as to generate a second driving force (F2 in FIG. 8) against the voice coil 30. The second driving force F2 may be a product of the magnetic induction density of the inductive gap G2, the length of the coil unit 41, and the current of the coil unit 41. In this way, the voice coil 30 simultaneously receives the first driving force F1 and the second driving force F2, so that the sensitivity is greatly improved.

Figure 9:
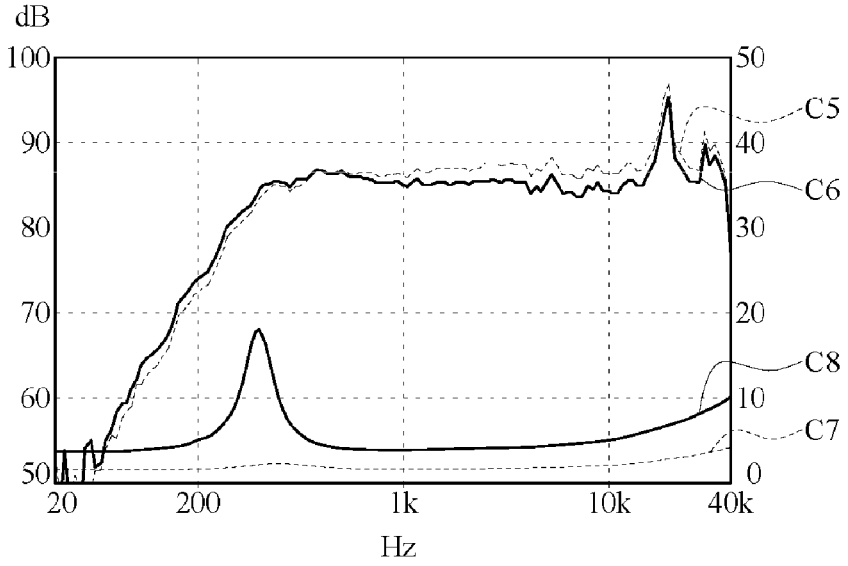
FIG. 9 is a signal curve chart of FIG. 7.

Further FIG. 9 shows a comparison of a case in which the open type inductive coil 40 is connected to the electric connection terminals 31, 32 and a case in which the inductive coil 40 is not connected to the electric connection terminals 31, 32. The horizontal axis represents the frequency (Hz), the left vertical axis represents the sound pressure level (dB), the right vertical axis represents the inductance, the curve C5 shows a sound pressure level-frequency curve generated when the open type inductive coil 40 is connected to the electric connection terminals 31, 32, the curve C6 shows a sound pressure level-frequency curve generated when the open type inductive coil 40 is not connected to the electric connection terminals 31, 32, the curve C7 shows an inductance-frequency curve generated when the open type inductive coil 40 is connected to the electric connection terminals 31, 32, and the curve C8 shows an inductance-frequency curve generated when the open type inductive coil 40 is not connected to the electric connection terminals 31, 32. By comparing the curve C7 and the curve C8, it can be learned that connecting the open type inductive coil 40 to the electric connection terminals 31, 32 can further reduce the inductance as compared with not connecting the open type inductive coil 40 to the electric connection terminals 31, 32 in an area at an intermediate or a high frequency band. Due to the reduction in the inductance, relatively, by comparing the curve C5 and the curve Cb, connecting the open type inductive coil 40 to the electric connection terminals 31, 32 can generate a relatively larger sound pressure level (that is, the sensitivity and sensibility are higher) as compared with not connecting the open type inductive coil 40 to the electric connection terminals 31, 32 in an area at an intermediate or high frequency band.

In other embodiments, the two signal transmission lines 45*a*, 45*b* of the open type inductive coil 40 may also be connected in series to the voice coil 30, so that the loudspeaker 1 changes from a full range unit to a mid-bass unit, thereby generating different sound field effects.

Figure 10:
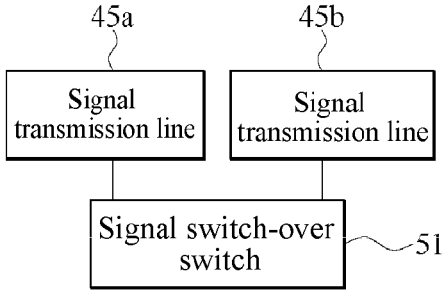
FIG. 10 is a schematic application diagram of a loudspeaker according to another embodiment of the present application.

Referring to FIG. 10, in an embodiment, one ends of the two signal transmission lines 45*a*, 45*b* that are exposed out of the yoke 10 and the annular magnet 20 may be connected to a signal switch-over switch 51, to switch over the mutual inductance signals by means of the signal switch-over switch 51, so as to change the sensitivity of the intermediate or high frequency, thereby changing the sound field and producing different sound output effects.

In summary, the loudspeaker of the present application can transmit mutual inductance signals between the coil unit and the voice coil to the outside by means of the signal transmission lines of the open type inductive coil, so that the mutual inductance signals can be obtained for use, adjustment, or monitoring, to further reduce the inductance at an intermediate or a high frequency, improve the sensibility of the loudspeaker, and change a sound field or monitor and adjust signals in a process of producing a product so as to improve the quality of the product.

Although the present application is disclosed above using the embodiments, the embodiments are not used to limit the present application, and some changes and modifications may be made by those skilled in the art without departing from the sprit and scope of the present application. Therefore, the protection scope of the present application is subject to the scope of the appended claims.

What is claimed is:

1. A loudspeaker, comprising:

a yoke;

an annular magnet, combined with the yoke;

a magnetic gap disposed between the annular magnet and the yoke;

a voice coil, disposed in the magnetic gap; and an open type inductive coil, arranged in the yoke or the annular magnet, the open type inductive coil adjacent to the voice coil, wherein an inductive gap is located between the open type inductive coil and the voice coil, the open type inductive coil comprising:

a coil unit; and two signal transmission lines, the coil unit comprises two opposite open ends, first ends of the signal transmission lines are respectively connected to the open ends, and second ends of the signal transmission lines are exposed out of the yoke and the annular magnet, so as to transmit mutual inductance signals between the coil unit and the voice coil to outside.

2. The loudspeaker according to claim 1, wherein the yoke has a U-shaped cross section and comprises:

a disc body; and an outer ring attached to an outer circumference of the disc body, wherein the annular magnet is disposed on the disc body, the magnetic gap is located between the outer ring and the annular magnet, a ring-shape trench is provided in an outer circumference of the annular magnet, and the coil unit is wound in the ring-shape trench.

3. The loudspeaker according to claim 2, wherein the annular magnet comprises:

a magnet; and a washer stacked on the magnet, and wherein the ring-shape trench is provided in an outer circumference of the washer.

4. The loudspeaker according to claim 1, wherein the yoke comprises:

a T-shaped cross section;

a chassis; and a central post attached to the center of the chassis, wherein the annular magnet is disposed on the chassis, the magnetic gap is located between the central post and the annular magnet, an annular recess is provided in an outer circumference of the central post, and the coil unit is wound in the annular recess.

5. The loudspeaker according to claim 1, wherein the coil unit is a multi-turn metal wire or a metal ring having a notch.

6. The loudspeaker according to claim 1, wherein the two signal transmission lines are further connected to a signal processor for receiving the mutual inductance signals, and wherein the mutual inductance signals comprise a voice coil input signal and a coil feedback signal, and the signal processor optionally processes for adding or subtracting the voice coil input signal and the coil feedback signal.

7. The loudspeaker according to claim 6, wherein a signal amplifier is further connected between the two signal transmission lines and the signal processor, and the signal amplifier amplifies the mutual inductance signals and transmits the amplified mutual inductance signals to the signal processor.

8. The loudspeaker according to claim 1, wherein the two signal transmission lines are further connected to a signal switch-over switch.

9. The loudspeaker according to claim 1, wherein the voice coil is electrically connected to two electric connection terminals, and second ends of the signal transmission lines are respectively, electrically connected to the two electric connection terminals and are connected in parallel with the voice coil.

10. The loudspeaker according to claim 1, wherein the two signal transmission lines are connected in series with the voice coil.

* * * * *